US011148867B1

(12) United States Patent
Boyd

(10) Patent No.: US 11,148,867 B1
(45) Date of Patent: Oct. 19, 2021

(54) DUNNAGE ASSEMBLY

(71) Applicant: The United States of America as Represented by the Secretary of the Navy, Indian Head, MD (US)

(72) Inventor: Eric R. Boyd, Ramsey, NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 17/300,149

(22) Filed: Mar. 29, 2021

(51) Int. Cl.
*B65D 81/113* (2006.01)
*B65D 85/68* (2006.01)

(52) U.S. Cl.
CPC ..... *B65D 81/113* (2013.01); *B65D 85/68* (2013.01); *B65D 2585/687* (2013.01)

(58) Field of Classification Search
CPC . B65D 81/113; B65D 85/68; B65D 2585/687
USPC ..... 206/3, 521, 593
See application file for complete search history.

(56) References Cited

U.S. PATENT DOCUMENTS 4,476,988 A * 10/1984 Tanner ..... F42B 39/00 206/3
4,538,724 A * 9/1985 Johnson ..... F42B 39/22 206/3
5,158,173 A * 10/1992 Halsey ..... F42B 39/14 206/3
6,123,208 A 9/2000 Haenszel
7,121,401 B1 10/2006 Sinha et al.
9,481,489 B2 11/2016 Bradford et al.
9,611,075 B2 4/2017 Bradford et al.
10,005,612 B2 * 6/2018 Jiang ..... B65D 81/113
10,386,167 B2 * 8/2019 Noble ..... B65D 55/04
10,501,263 B2 12/2019 Kraeling
10,604,334 B2 3/2020 Bradford et al.

FOREIGN PATENT DOCUMENTS

WO WO2006/116589 11/2006
WO WO2015/017408 2/2015

* cited by examiner

*Primary Examiner* — Jacob K Ackun
(74) *Attorney, Agent, or Firm* — Fredric J. Zimmerman

(57) ABSTRACT

A dunnage assembly has a plurality of tubes and a locking bridge movably attached to the tubes. The locking bridge has radially sections extending through corresponding slots in the tubes and into the tube interior regions. A stop member movably positioned within each tube interior region and attached to the portion of the radially extending section located within the tube interior region. The locking bridge and stop members move together. As the locking bridge moves along the lengths of the tubes, the stop members move within the tube interior regions. The locking bridge may be locked at a desired location along the tube to position the stop members at a desired location within the tube interior regions. The adjustability of the stop members allows the tubes to receive rockets of various lengths and nose profiles. The locking bridge may be unlocked to re-position the stop members.

20 Claims, 14 Drawing Sheets

DUNNAGE ASSEMBLY

STATEMENT OF GOVERNMENT INTEREST

The invention described herein may be manufactured and used by or for the government of the United States of America for governmental purposes without the payment of any royalties thereon or therefor.

TECHNICAL FIELD

Embodiments of a dunnage assembly are disclosed herein.

BACKGROUND

Rockets are typically manufactured at facilities that are remote from where the rockets are actually deployed and used. Therefore, it is necessary to ship the rocket to the location where the rocket will be deployed. The rocket is typically loaded into a dunnage assembly that is configured to be positioned within the interior of a shipping container. The shipping container typically has an open aft end, a closed forward end and a cover that is configured to be removably attached to the open aft end so as to prevent the dunnage assembly from sliding out of the shipping container. Typically, the dunnage assembly includes a plurality of tubes that are held together a plurality of collars. Typically, there are four tubes where each tube is configured to receive a corresponding rocket. Each collar has a plurality of openings where each opening receives a corresponding tube. Once the dunnage assembly is inserted into the shipping container, the rockets are then inserted into the corresponding tubes. After the rockets are inserted into the dunnage assembly, the shipping container cover (not shown) is attached to the open aft end of the shipping container. Since rockets come in a variety of shapes, sizes and lengths, different size dunnage assemblies must be available in order to ship the various sized rockets. However, rockets having different lengths cannot be shipped in the same container because each rocket would have to have its own particular dunnage assembly and there would be no room within the shipping container for multiple dunnage assemblies. Furthermore, a unique dunnage assembly for holding a rocket having a particular length typically requires a unique shipping container specifically tailored to receive the unique dunnage assembly. Consequently, the manufacture or purchase of differently configured dunnage assemblies and corresponding shipping containers results in higher shipping costs. Additionally, storing large numbers of differently configured dunnage assemblies and corresponding shipping containers consumes significant amounts of warehouse space and complicates inventory management.

What is needed is a dunnage assembly that eliminates the aforementioned problems and disadvantages associated with conventional dunnage assemblies.

SUMMARY

This summary is provided to introduce a selection of concepts in a simplified form that are further described below in the detailed description. This summary is not intended to identify key features or essential features of the claimed subject matter, nor is it intended to be used in isolation as an aid in determining the scope of the claimed subject matter.

In an embodiment, the dunnage assembly includes a plurality of storage tubes arranged in juxtaposition. Each tube is attached to at least one other tube. Each tube has a tube wall, a tube interior region, an open first end in communication with the tube interior region and an opposite second end. In an exemplary embodiment, the opposite second end is open and in communication with the tube interior region. Each tube has a longitudinally extending axis, a predefined length and a longitudinally extending tube slot that extends from the first end to the opposite second end. The tube slot has a first longitudinally extending edge and an opposing second longitudinally extending edge. The first longitudinally extending edge has a first plurality of notches therein and the opposing second longitudinally extending edge has a second plurality of notches therein. Each notch of the first plurality of notches is aligned with a corresponding notch of the second plurality of notches so as to define a pair of aligned notches. Each pair of aligned notches is located at a predefined location along the predefined length of the tube. The orientation and position of the tubes provides a longitudinally extending central space between the tubes. The longitudinally extending central space extends for the predefined length of the tubes. The dunnage assembly further includes a locking bridge located within the longitudinally extending central space. The locking bridge has a plurality of radially extending sections that are equidistantly spaced apart. Each radially extending section extends through the tube slot of a corresponding tube and into the tube interior region such that the locking bridge is slidably engaged to each tube and movable through the longitudinally extending central space. The locking bridge further includes a pivotable mechanism having a plurality of radially extending fingers. Each radially extending finger is sized to fit into any of the notches in the first longitudinally extending edge and second longitudinally extending edge of the tube slot. The pivotable mechanism includes a torsion spring system to produce a torsion force to urge the pivotable mechanism to a first position wherein each radially extending finger is inserted into a corresponding notch so as to lock the locking bridge and prevent the locking bridge from movement. The pivotable mechanism is pivotable to a second position where the radially extending fingers are withdrawn from the notches so as to unlock the locking bridge thereby allowing movement of the locking bridge throughout the longitudinally extending central space. The dunnage assembly further comprises a plurality of stop members. Each stop member is positioned within a corresponding tube interior region and attached to a corresponding radially extending section of the locking bridge. Thus, the stop members and locking bridge function as a single component such that the stop members move through the tube interior regions as the locking bridge moves throughout the longitudinally extending central space. Each stop member is configured to receive an end of a longitudinally extending object that is to be stored in the tube interior region. An example of such a longitudinally extending object is a rocket. Whereby, in order to position each stop member at a desired location within a corresponding tube interior region, the pivoting mechanism is pivoted to the second position to withdraw the radially extending fingers from the notches so as to unlock the locking bridge so that the locking bridge may be moved through the longitudinally extending central space until the stop members are positioned at the desired location. Whereupon, the torsion spring system is allowed to force pivoting mechanism to the first position so as to position the radially extending fingers in the notches corresponding to the desired location and lock the locking bridge and stop members in place.

Although the dunnage assembly disclosed herein is described in terms of the dunnage assembly being used to hold rockets, it is to be understood that the dunnage assembly may be used to hold and transport other fragile, longitudinally extending objects or components.

DETAILED DESCRIPTION

As used herein, the terms "comprise", "comprising", "comprises", "includes", "including", "has", "having" or any other variation thereof, are intended to cover a non-exclusive inclusion. For example, a process, method, article or apparatus that comprises a list of elements is not necessarily limited to only those elements, but may include other elements not expressly listed or inherent to such process, method, article or apparatus.

As used herein, terms such as "vertical", "horizontal", "top", "bottom", "upper", "lower", "middle", "above", "below" and the like are used for convenience in identifying relative locations of various components and surfaces relative to one another in reference to the drawings and that the dunnage assembly disclosed herein may be installed and used in substantially any orientation so that these terms are not intended to be limiting in any way.

Figure 5A:
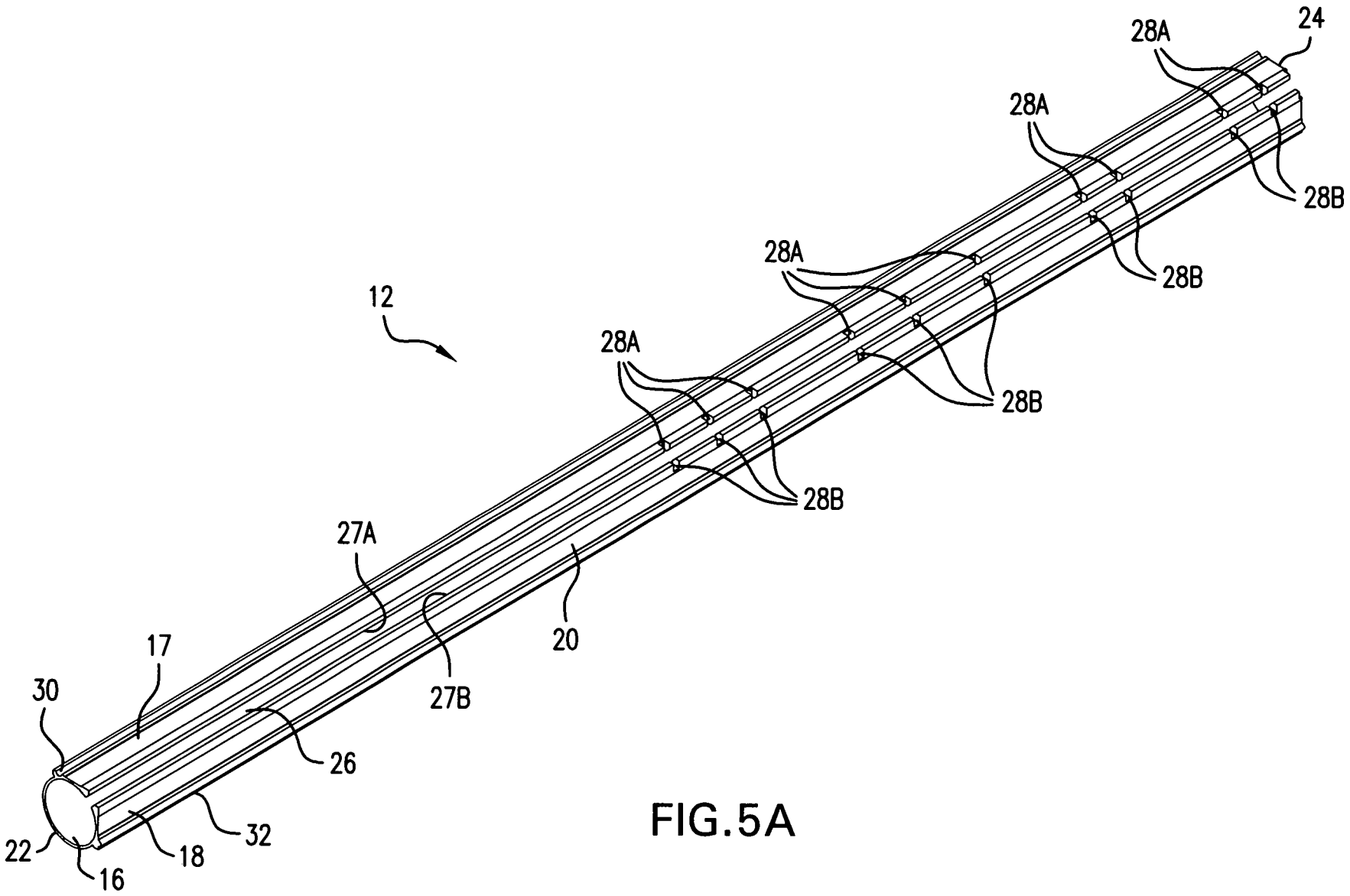
FIG. 5A is a perspective view of the storage tube of FIG. 4.
Figure 5B:
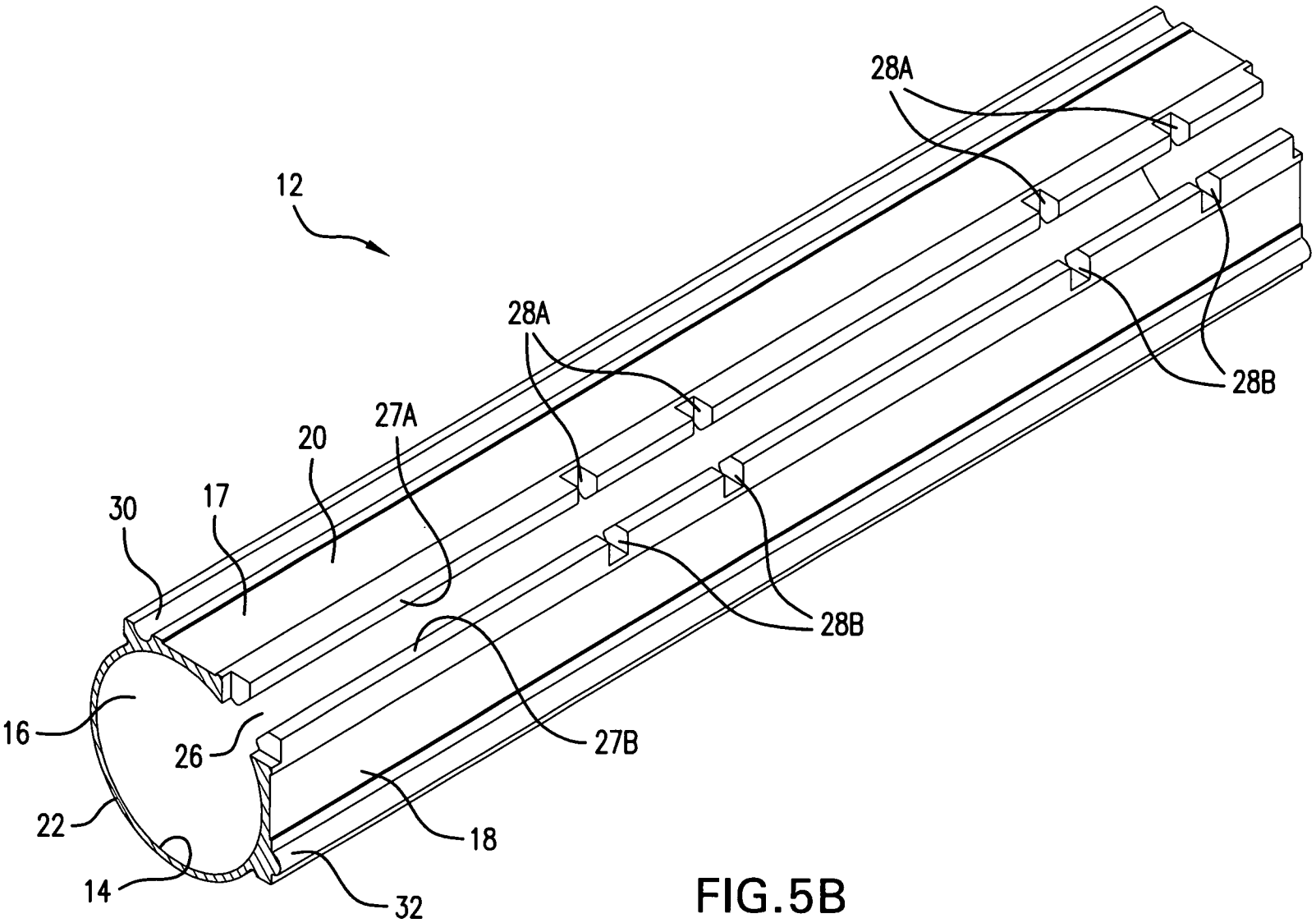
FIG. 5B is a partial, enlarged view, in cross-section, of the storage tube shown in FIG. 5A.

Referring to FIGS. 1A, 3, 4 and 5A, there is shown an exploded view of dunnage assembly 10 in accordance with an exemplary embodiment. Dunnage system 10 includes a plurality of storage tubes 12 arranged in juxtaposition such that each tube 12 is parallel to the other tubes 12. In some embodiments, there are four tubes 12. In other embodiments, there are more than or less than four tubes 12. Tubes 12 have the same structure and configuration. Each tube 12 has a predetermined inner diameter, outer diameter and length. Tubes 12 may have any suitable or desired lengths. In an exemplary embodiment, each tube 12 is about six feet in length. Tubes 12 may be fabricated from a variety of materials such as acrylonitrile butadiene styrene (ABS), rubber, resin, neoprene, plastic, polystyrene, polyvinylchloride (PVC), polycarbonate, sugarcane-based polyethylene and composites. Tubes 12 may be fabricated from suitable metals, alloys or metallic compositions. In an exemplary embodiment, tubes 12 are fabricated from Aluminum. The arrangement of tubes 12 provides centrally space 13 that extends for substantially the entire length of the tubes 12. Each tube 12 includes tube wall 14 and tube interior region 16 for receiving a longitudinally extending object such as a rocket or similar object. Tube wall 14 includes wall portions 17 and 18 which have thicknesses that are greater than the thickness of the remaining portion of tube wall 14. The purpose of wall portions 17 and 18 is discussed in the ensuing description. Each tube 12 is configured so that its inner diameter allows the insertion therethrough of the rocket or other object but yet prevents the rocket from any rolling or rocking when positioned within tube interior region 16. For example, each tube 12 may be internally sized to receive a commonly used 2.75 inch military rocket which has an outer diameter of about 2.75 inches. Each tube 12 has a first end 22 and opposite second end 24 (see FIG. 5A). First end 22 is open and is in communication with interior region 16. In an embodiment, second end 24 is also open and in communication with interior region 16. In other embodiments, second end 24 is closed. Each tube wall 14 has longitudinally extending tube slot 26 that extends for the entire length of tube 12. As shown in FIG. 5A, tube slot 26 extends from first end 22 to second end 24 and is located between tube wall portions 17 and 18. Referring to both FIGS. 5A and 5B, tube slot 26 has a first longitudinally extending edge 27A and an opposing second longitudinally extending edge 27B. Each tube 12 has a plurality of notches 28 in edges 27A and 27B. The plurality of notches 28 in edge 27A are indicated by reference numbers 28A and the plurality of notches 28 in edge 27B are indicated by reference numbers 28B. Each notch 28A is aligned with a corresponding notch 28B so as to define a pair of aligned notches. Each pair of aligned notches is located at a predefined location along the predefined length of tube 12. The purposes of slots 26 and notches 28 are discussed in the ensuing description. Tubes 12 are positioned within collars 29 as shown in FIG. 1. Collars 29 are configured with a cut-out that is shaped to receive tubes 12 when tubes 12 are attached together. Each collar 29 includes a plurality of openings 29A. The purpose of collars 29 and openings 29A is discussed in the ensuing description.

Referring to FIGS. 1A, 3, 4 and 5A, each tube 12 is removably attached to at least one other tube 12. In an exemplary embodiment, each tube 12 is removably attached to two other tubes 12. In exemplary embodiment, tube wall 14 of each tube 12 has a longitudinally extending groove 30 in exterior side 20 of tube wall portion 17 (see FIG. 4). Tube wall 14 further includes longitudinally extending rib 32 in exterior side 20 of tube wall portion 18. Longitudinally extending rib 32 is sized to frictionally fit into the longitudinally extending groove 30 of an adjacent tube 12. In order to facilitate understanding of this feature, reference is made to FIG. 3 wherein tubes 12 are indicated by references numbers 12A-D. Thus, in one exemplary embodiment, longitudinally extending rib 32 of tube 12B is frictionally fitted into the longitudinally extending groove 30 of tube 12A. The corresponding longitudinally extending rib 32 of tube 12A is frictionally fitted into a corresponding longitudinally extending groove 30 of tube 12D. The corresponding longitudinally extending rib 32 of tube 12C is frictionally fitted into the longitudinally extending groove 30 of tube 12B, and the corresponding longitudinally extending rib 32 of tube 12D is frictionally fitted into the longitudinally extending groove 30 of tube 12C.

Figure 8:
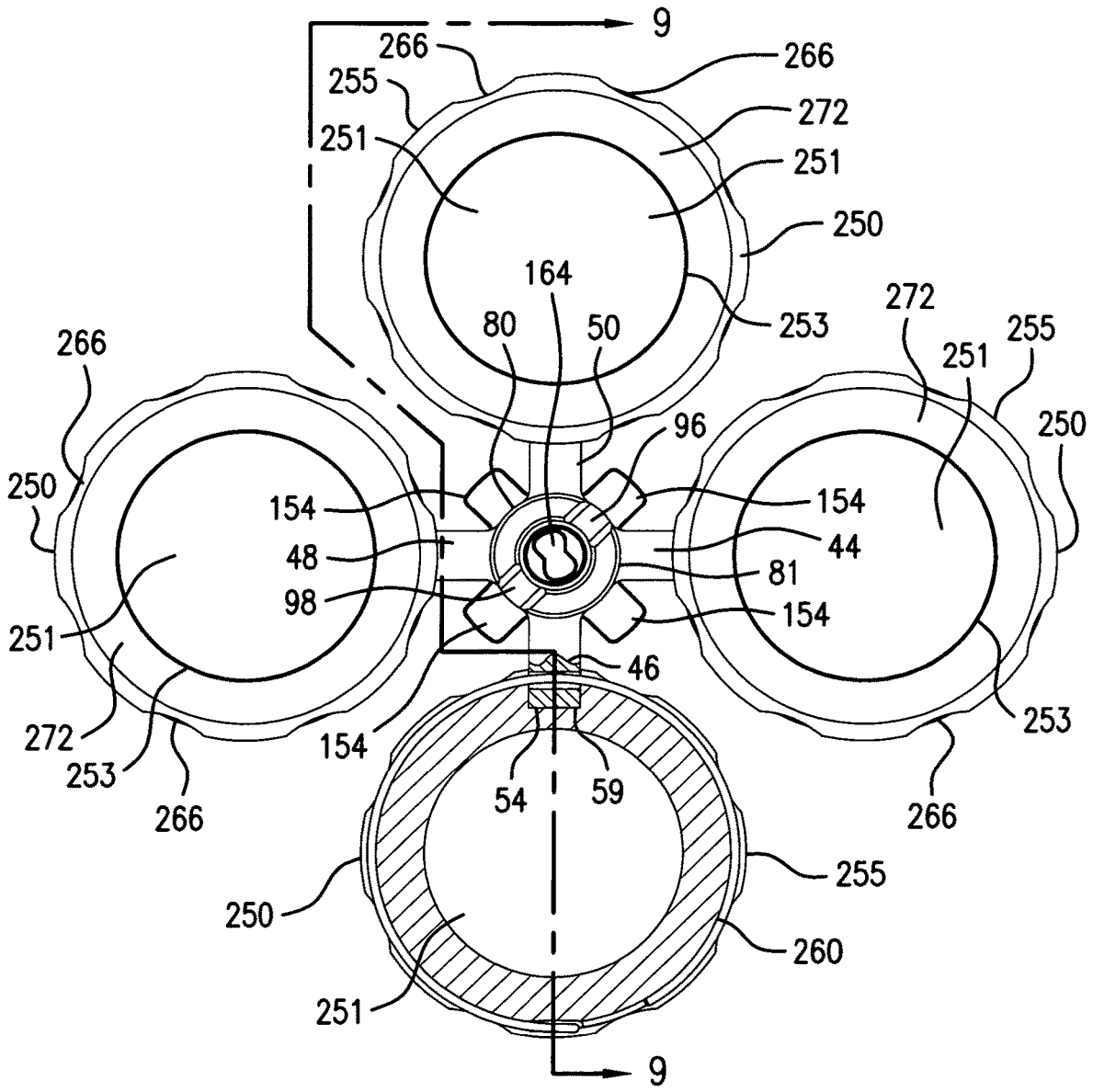
FIG. 8 is an end view, partially in cross-section, showing the stop members attached to the locking bridge.
Figure 9:
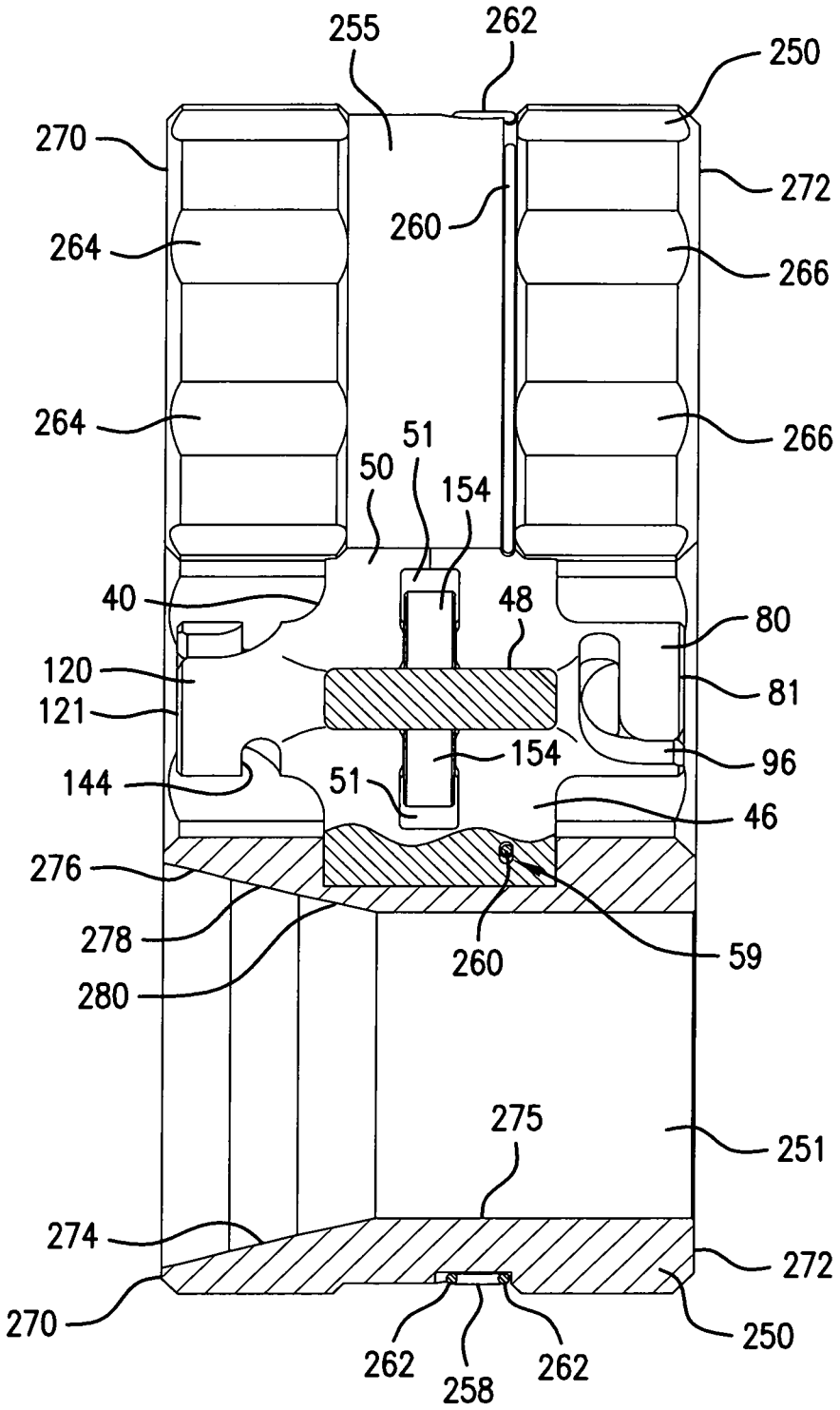
FIG. 9 is a view taken along line 9-9 in FIG. 8.
Figure 10:
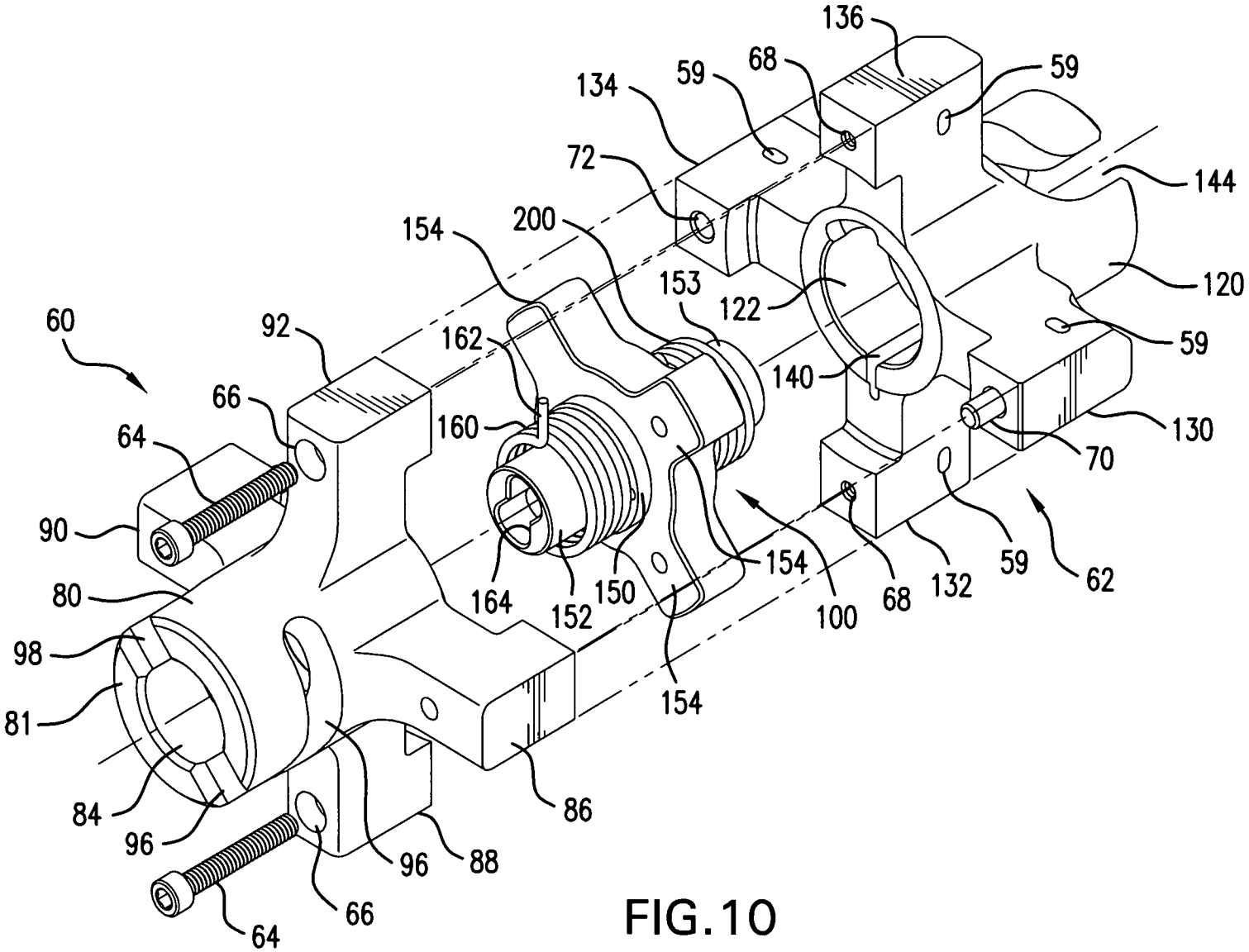
FIG. 10 is an exploded view of the locking bridge.
Figure 11:
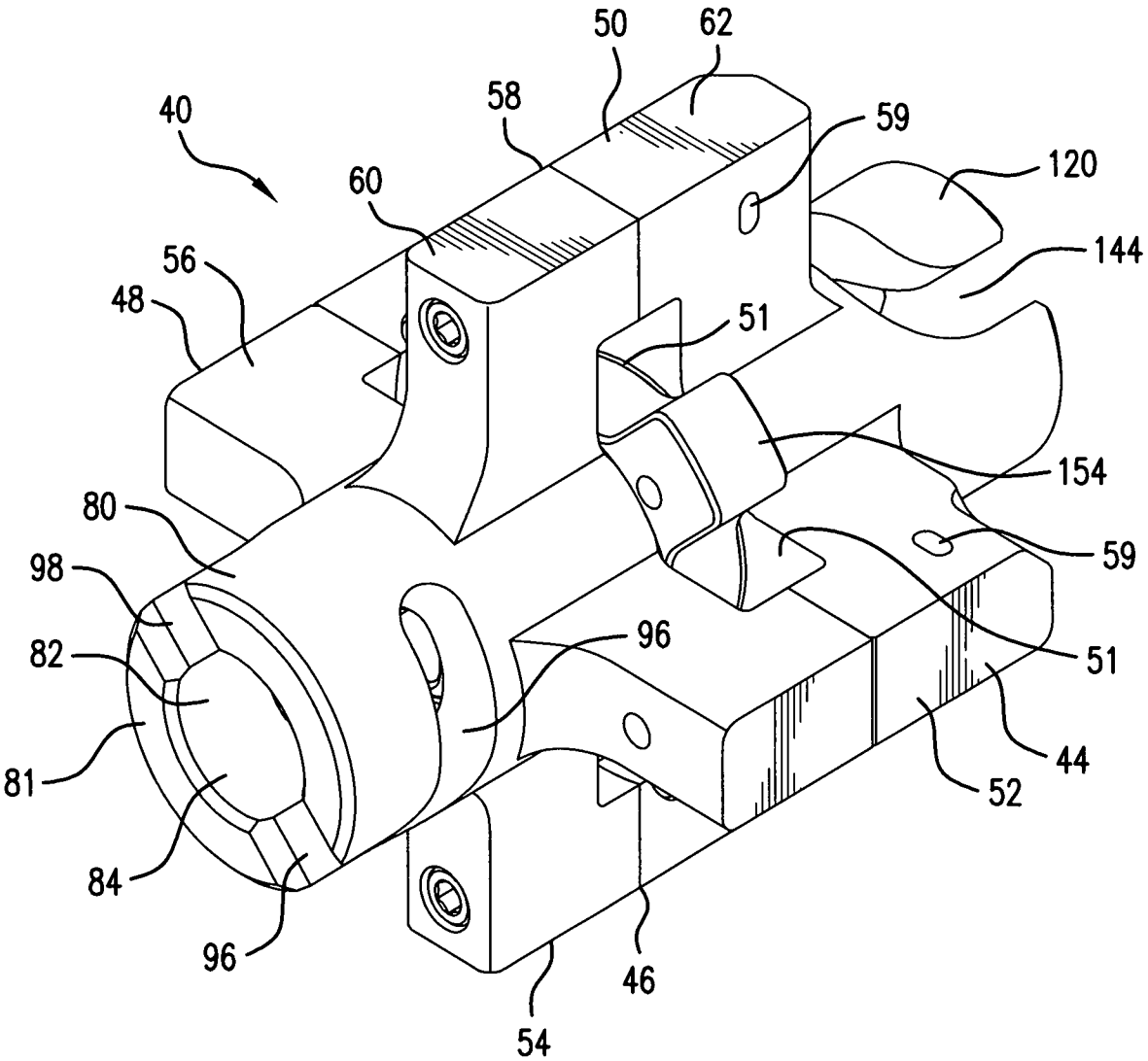
FIG. 11 is a perspective view of the locking bridge.
Figure 13:
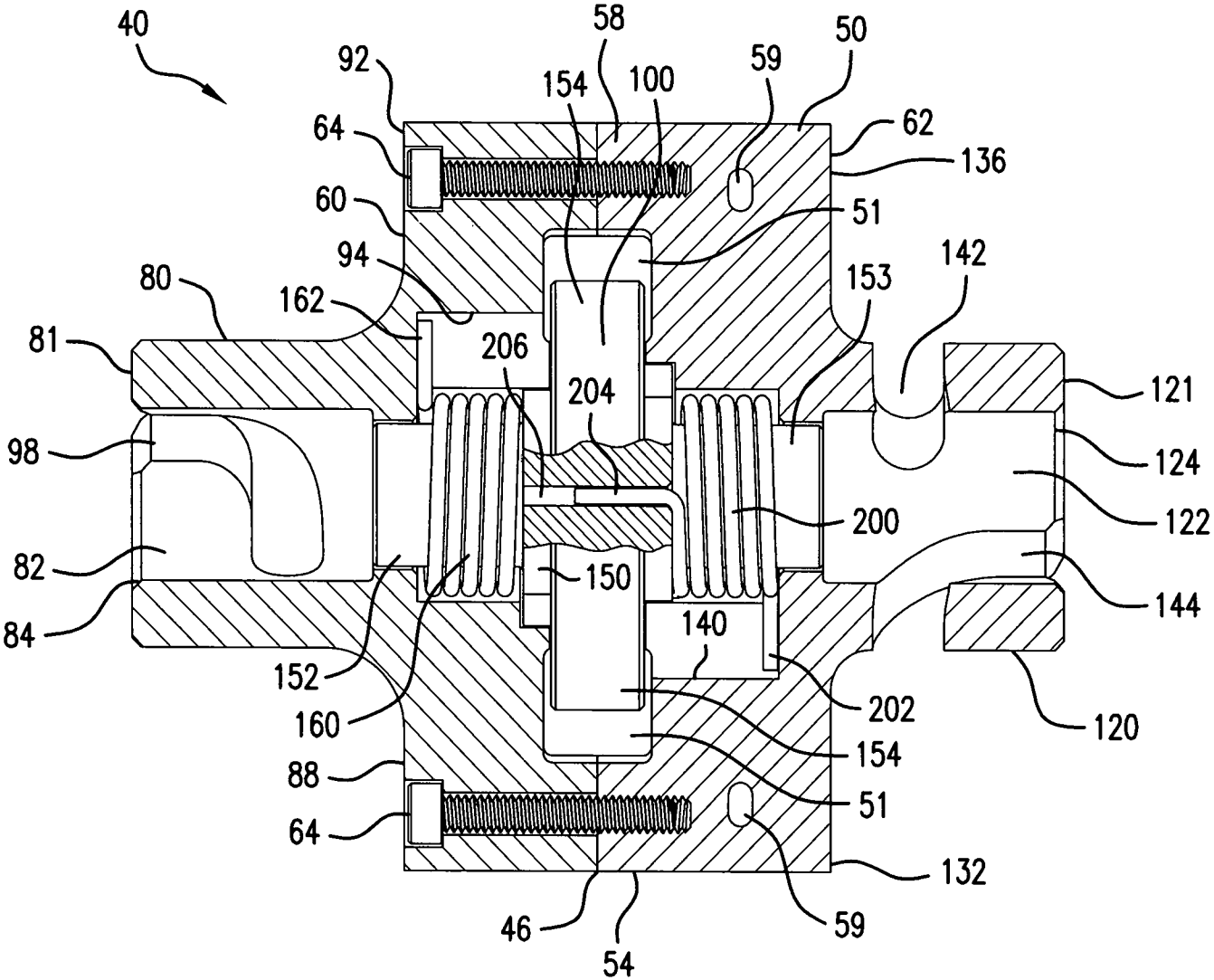
FIG. 13 is a cross-sectional view taken along line 13-13 in FIG. 12.

Referring to FIGS. 1A and 6-10, dunnage assembly 10 further includes locking bridge 40 that is positioned within central space 13 and movably secured to tubes 12. When unlocked, locking bridge 40 is movable through central space 13 and along the lengths of tubes 12. As will be explained in the ensuing description, a plurality of stop members 250 are attached to locking bridge 40 such that locking bridge 40 and stop members 250 function as a single component. Each stop member 250 is positioned within a corresponding tube interior region 16. In order to facilitate understanding of dunnage assembly 10, locking bridge 40 is first described without stop members 250 in order to clearly illustrate the structure and mechanics of locking bridge 40. Locking bridge 40 comprises first housing section 60 and second housing section 62 which, when joined or attached together, provide a plurality of radially extending sections 44, 46, 48 and 50 that are equidistantly spaced. In such an exemplary embodiment, radially extending sections 44, 46, 48 and 50 are at right angles to each other. Each radially extending section 44, 46, 48 and 50 has an opening 51 into which a corresponding extending finger 154 enters when locking bridge 40 is unlocked. This feature is discussed in detail in the ensuing description. Radially extending sections 44, 46, 48 and 50 have portions 52, 54, 56 and 58, respectively. Each radially extending section 44, 46, 48 and 50 extends through a longitudinally extending slot 26 of a corresponding tube 12. As a result of such a configuration, each portion 52, 54, 56, and 58 is positioned within a corresponding tube interior region 16. As shown in FIGS. 10, 11 and 13, each portion 52, 54, 56 and 58 has through-hole 59. The purpose of each through-hole 59 is discussed in the ensuing description. Locking bridge 40 is slidably engaged with all tubes 12 and when locking bridge 40 is unlocked, it may be moved throughout longitudinally extending central space 13. Since longitudinally extending slots 26 extends to first end 22 and opposite second end 24, locking bridge 40 may be slid toward first end 22 or opposite second end 24 so that locking bridge 40 can be removed from central space 13 and disengaged from tubes 12. Once locking bridge is removed from central space 13 and disengaged from tubes 12, locking bridge 40 may be reoriented and then inserted back into central space 13 and re-engaged with tubes 12. This feature is discussed in detail in the ensuing description.

Referring to FIGS. 6 and 10-13, first housing section 60 and second housing section 62 are attached or joined together by any suitable means or technique. In some exemplary embodiments, first housing section 60 and second housing section 62 are joined or attached together via screws 64 that are inserted through through-holes 66 in first housing section 60 and engaged with threaded inlets 68 in second housing section 62. In order to provide further structural integrity and to ensure proper orientation of first housing section 60 and second housing section 62, second housing section 62 includes alignment pin 70 that is inserted into a corresponding cavity or bore (not shown) in first housing section 60. Similarly, first housing section 60 includes an alignment pin (not shown) that is inserted into cavity or bore 72 in second housing section 62. First housing section 60 includes generally cylindrical body portion 80 that has end portion 81, interior space 82 and opening 84. Opening 84 is in communication with interior space 82. First housing section 60 includes extending portions 86, 88, 90 and 92 that radially extend from generally cylindrical body portion 80. Each extending portion 86, 88, 90 and 92 forms a part of a radially extending section 44, 46, 48 and 50, respectively. Each extending portion 86, 88, 90 and 92 has a cut-out or notched region that forms part of opening 51 in each radially extending section 44, 46, 48 and 50, respectively. Generally cylindrical body portion 80 includes internal channel 94 that extends in a direction that is substantially parallel to the longitudinally extending axis of generally cylindrical body portion 80. The purpose of channel 94 is discussed in the ensuing description.

Referring to FIGS. 1A, 6, 10 and 13, opening 84 is sized to allow insertion therethrough of adjustment rod 102 that is configured to engage pivotable mechanism 100 in order to lock or unlock locking bridge 40. As will be discussed in the ensuing description, pivotable mechanism 100 is spring loaded and normally configures locking bridge 40 to a locked state. Thus, the locked state constitutes the default state. As shown in FIGS. 10 and 13, generally cylindrical body portion 80 has therein a pair of curved slots 96 and 98. Each slot 96 and 98 starts in end 81 (see FIGS. 10 and 13) of generally cylindrical body portion 80 and extends for a portion of the circumference of generally cylindrical body portion 80. Adjustment rod 102 includes shaft section 104 and head section 105 that is attached to shaft section 104. Head section 105 is sized to fit through opening 84 in generally cylindrical body portion 80. Head section 105 includes diametrically positioned protruding members 106 that are sized to fit into curved slots 96 and 98. Head section 105 further includes key structure 108 that functions as a key and is configured to fit into a first keyway of pivotable mechanism 100. The first keyway is discussed in the ensuing description. The use of adjustment rod 102 to pivot pivotable mechanism 100 counter-clockwise is discussed in detail in the ensuing description. Adjustment rod 102 includes ring or circular member 110 attached to the front end of shaft section 104. Ring or circular member 110 is sized to receive a user's finger and provide an external grip to allow the user to maneuver adjustment rod 102. However, member 110 may be configured to have other suitable shapes or geometries that allow adjustment rod 102 to be pushed, pulled and turned. For example, member 110 may be configured to have a "T" shape.

Referring to FIGS. 6 and 10-13, second housing section 62 includes generally cylindrical body portion 120 which has end portion 121, interior space 122 and opening 124. Opening 124 is in communication with interior space 122. Second housing section 62 includes extending portions 130, 132, 134 and 136 that radially extend from generally cylindrical body portion 120. Each extending portion 130, 132, 134 and 136 forms a portion of a radially extending section 44, 46, 48 and 50, respectively. Each extending portion 130, 132, 134 and 136 has a cut-out or notched region that forms part of opening 51 in radially extending sections 44, 46, 48 and 50, respectively. Generally cylindrical body portion 120 includes internal channel 140 that extends in a direction that is substantially parallel to the longitudinally extending axis of generally cylindrical body portion 120. The purpose of channel 140 is discussed in the ensuing description. Generally cylindrical body portion 120 has therein a pair of curved slots 142 and 144. Each slot 142 and 144 starts in end 121 (see FIG. 13) of generally cylindrical body portion 120 and extends for a portion of the circumference of generally cylindrical body portion 120. Head section 105 of adjustment rod 102 is sized to fit through opening 124 in generally cylindrical body portion 120. Protruding members 106 of head section 105 are sized to fit into curved slots 142 and 144. As discussed in the foregoing description, key structure 108 of head section 105 functions as a key and is configured to fit into a second keyway of pivotable mechanism 100. The second keyway is discussed in the ensuing description. The use adjustment rod 102 to pivot pivotable mechanism 100 in the clockwise direction is discussed in detail in the ensuing description.

Referring to FIGS. 10-13, pivotable mechanism 100 includes central body 150 having first portion 152 and second portion 153. A plurality of fingers 154 radially extend from generally cylindrical body 150. Each finger 154 corresponds to one of the tubes 12. In an exemplary embodiment, fingers 154 are equidistantly spaced. In an exemplary embodiment, there are four fingers 154 that are spaced apart by about 90°. First torsion spring member 160 is attached to first portion 152 of central body 150. Specifically, first torsion spring 160 includes a first end portion (not shown) that is disposed within a bore (not shown) in central body 150. (This configuration is similar to the manner in which second torsion spring 200 is attached to second portion 153 which is discussed in the ensuing description.) As a result of this configuration, first torsion spring 160 rotates with first portion 152. First torsion spring member 160 has an outwardly extending second end portion 162. First torsion spring member 160 is oriented on first portion 152 so that outwardly extending end portion 162 extends upward. First portion 152, with first torsion spring member 160 attached thereto, is disposed within interior space 82 of generally cylindrical body portion 80. When first portion 152, with spring member 160 attached thereto, is positioned within interior space 82 during assembly, a force is applied to end portion 162 in order to position it within interior channel 94 of generally cylindrical body portion 80 so as to preload first torsion spring member 160. In such a configuration, torsion spring member 160 constantly produces a torsion force that urges or forces pivotable mechanism 100 in the clockwise direction, when viewing locking bridge 40 from end portion 81 of generally cylindrical body portion 80. First portion 152 includes first keyway 164 which is configured to receive key structure 108 of adjustment rod 102.

In order to pivot pivotable mechanism 100 in the counter-clockwise direction, a user maneuvers adjustment rod 102 so that protruding members 106 enter curved slots 96 and 98 and key structure 108 enters first keyway 164. Adjustment rod 102 follows the curvature of slots 96 and 98 and starts to rotate as protruding members 106 move through curved slots 96 and 98. Although key structure 108 has entered first keyway 164, key structure 108 is not yet in contact with the inner walls of first keyway 164 and therefore, first keyway 164 does not yet start turning or pivoting. After protruding members 106 have travelled a predefined distance through curved slots 96 and 98, key structure 108 contacts the inner walls of first keyway 164. As the user continues to rotate adjustment rod 102 counter-clockwise, the key structure 108 turns or pivots first keyway 164, and hence pivotable mechanism 100, in the counter-clockwise direction. In an exemplary embodiment, curved slots 96 and 98 are configured so that the key structure 108 starts to pivot first keyway 164 during the last 45° of rotation of adjustment rod 102. The user rotates adjustment rod 102 counter-clockwise with enough torque to overcome the opposing torsion force created by pre-loaded torsion spring members 160 and 200.

Second torsion spring member 200 is attached to second portion 153 of central body 150. Second torsion spring member 200 has outwardly extending first end portion 202. Second torsion spring member 200 is oriented on second portion 153 so that outwardly extending first end portion 202 extends downward. Second torsion spring member 200 includes second end portion 204 that is disposed within bore 206 in central body 150 (see FIG. 13). As a result of this configuration, second torsion spring 200 rotates with second portion 153. Second portion 153, with torsion spring member 200 attached thereto, is disposed within interior space 122 of generally cylindrical body portion 120. When second portion 153, with spring member 200 attached thereto, is positioned within interior space 122 during assembly, a force is applied to first end portion 202 in order to position it within interior channel 140 of generally cylindrical body portion 120 so as to preload second torsion spring member 200. In such an exemplary configuration, torsion spring member 200 produces a torsion force that constantly urges or forces pivoting mechanism 100 in the counter-clockwise direction, when viewing locking bridge 40 from end portion 121 of generally cylindrical body portion 120. Second portion 153 includes second keyway 204 that is configured to receive key structure 108.

In order to pivot pivotable mechanism 100 in the clockwise direction, a user maneuvers adjustment rod 102 so that protruding members 106 enter curved slots 142 and 144 in generally cylindrical body portion 120 and key structure 108 enters second keyway 204. Adjustment rod 102 follows the curvature of slots 142 and 144 and starts to rotate as protruding members 106 move through curved slots 142 and 144. Although key structure 108 has entered second keyway 204 at this time, key structure 108 is not yet in contact with the inner walls of second keyway 204 and therefore, second keyway 204 does not yet start turning or pivoting. After protruding members 106 have travelled a predefined distance through curved slots 142 and 144, key structure 108 contacts the inner walls of second keyway 204. As the user continues to rotate adjustment rod 102 clockwise, the key structure 108 turns or pivots second keyway 204, and hence pivotable mechanism 100, in the clockwise direction. In an exemplary embodiment, curved slots 142 and 144 are configured so that the key structure 108 starts to turn or pivot second keyway 204 during the last 45° of rotation of adjustment rod 102. The user rotates adjustment rod 102 clockwise with enough torque to overcome the opposing torsion force created by pre-loaded torsion spring members 160 and 200.

Torsion spring members 160 and 200 bias pivotable mechanism 100 to a normal or default state in which extending fingers 154 are lodged in corresponding notches 28. As a result, locking bridge 40 is locked in position and cannot move unless pivotable mechanism 100 is pivoted to withdraw extending fingers 154 from notches 28. In order to unlock locking bridge 40, adjustment rod 102 is used to pivot pivotable mechanism 100 either counter-clockwise, when viewing locking bridge 40 from end 81 of generally cylindrical body portion 80, or clockwise, when viewing locking bridge 40 from end 121 of generally cylindrical body portion 120. Other than when adjustment rod 102 is pivoting pivotable mechanism 100 in the clockwise or counter-clockwise directions, torsion springs 160 and 200 maintain pivotable mechanism 100 in the normal or default state.

Figure 12:
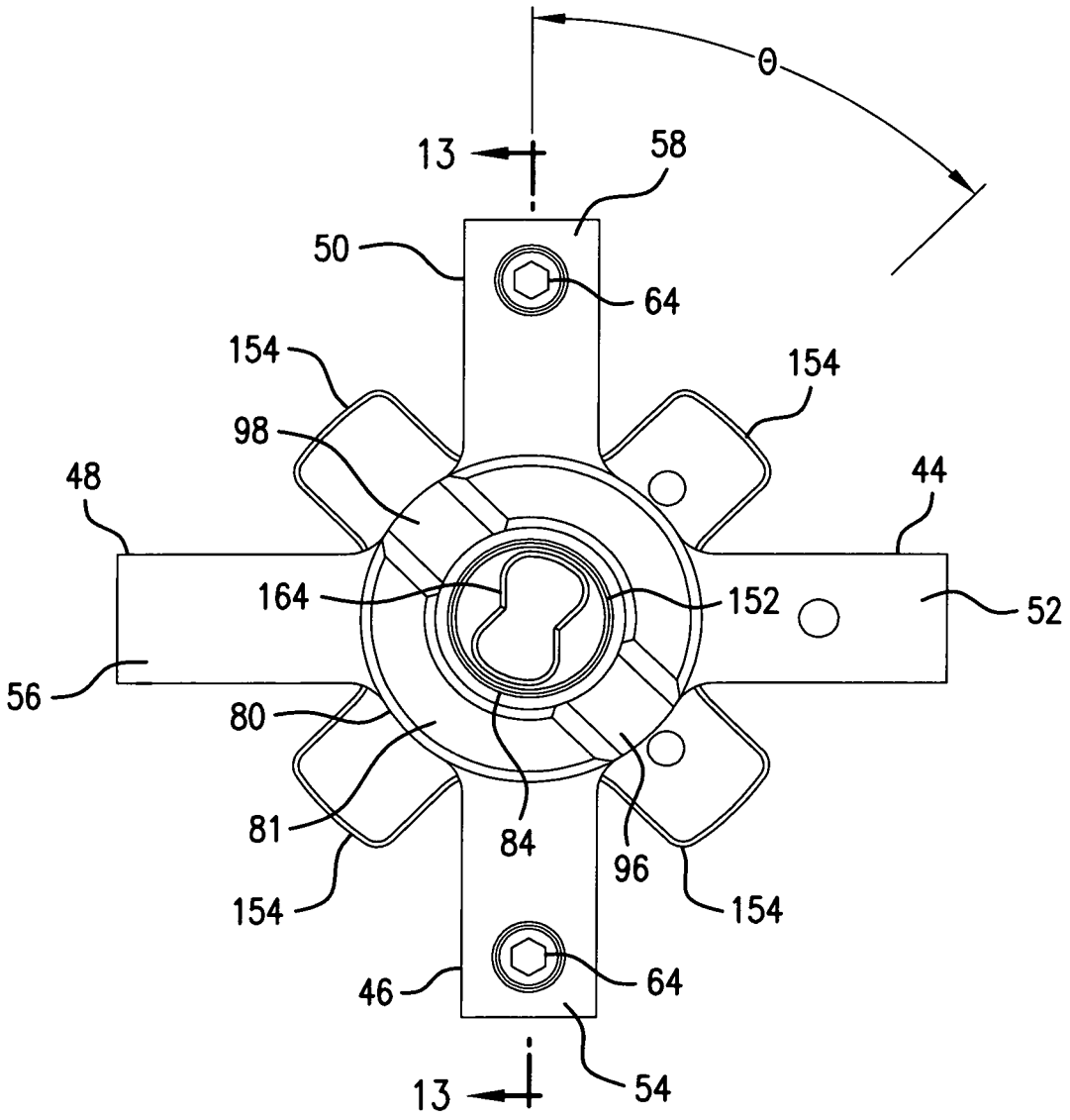
FIG. 12 is an view of the locking bridge.

If it is desired to move locking bridge 40 along the lengths of tubes 12 to a different position, then a user must first unlock locking device 40. The user may use adjustment rod 102 to pivot pivotable mechanism 100 either counter-clockwise or clockwise as described in the foregoing description. If the user is facing the ends 22 of tubes 12 as well as end portion 81 of locking bridge 40, then the user inserts head section 105 of adjustment rod 102 through opening 84 so that protruding members 106 enter curved slots 96 and 98 and key structure 108 enters keyway 164 as described in the foregoing description. The user then pivots pivotable mechanism 100 counter-clockwise so that extending fingers 154 are withdrawn from notches 28. When the user pivots pivotable mechanism 100 to the fullest extent, extending fingers 154 enter or retract into corresponding openings 51 in extending sections 44, 46, 48 and 50. Once extending fingers 154 are withdrawn from notches 28 and are positioned within openings 51, the user may slide locking bridge 40 along the lengths of tubes 12A, 12B, 12C and 12D in order to position extending fingers 154 in a different set of notches 28 that correspond to a different point along the lengths of tubes 12A, 12B, 12C and 12D. Once locking bridge 40 is positioned so that extending fingers 154 are aligned with the desired set of notches 28, the user releases tension on adjustment rod 102 so that torsion springs 160 and 200 force pivotable mechanism 100 in the clockwise direction such that extending fingers 154 are inserted into the new set of notches 28. Locking bridge 40 is now in the locked state again. Referring to FIG. 12, angle θ represents the range of angular movement of each extending finger 154. In an exemplary embodiment, angle θ is about 45°.

Figure 6:
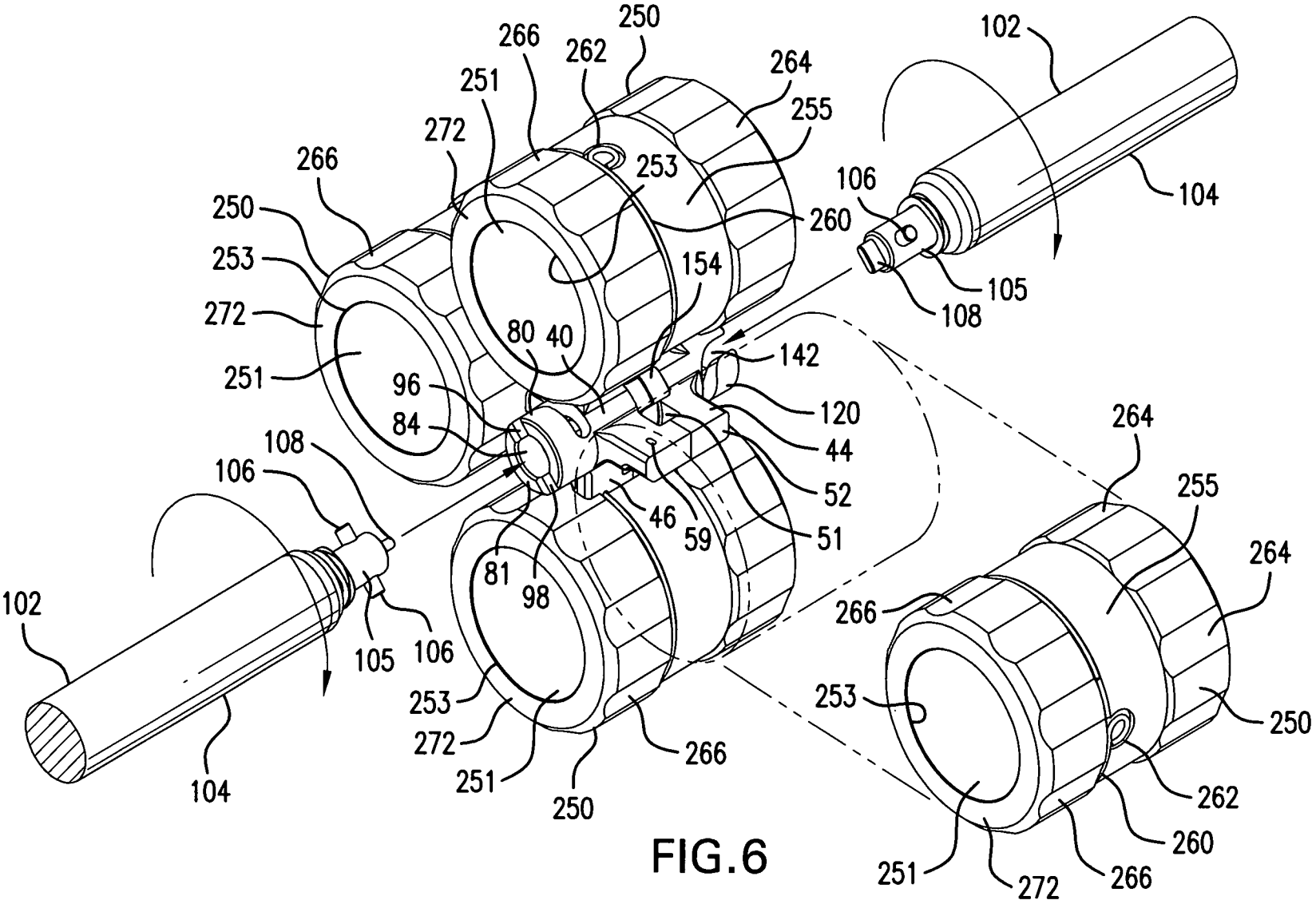
FIG. 6 is an exploded view, in perspective, of the stop members and locking bridge shown in FIG. 1, the view illustrating how the adjustment rod shown in FIG. 1 is used to engage the locking bridge and stop members in order to adjust the position of the stop members to allow objects of various lengths and nose configurations to be stored in the storage tubes.
Figure 7:
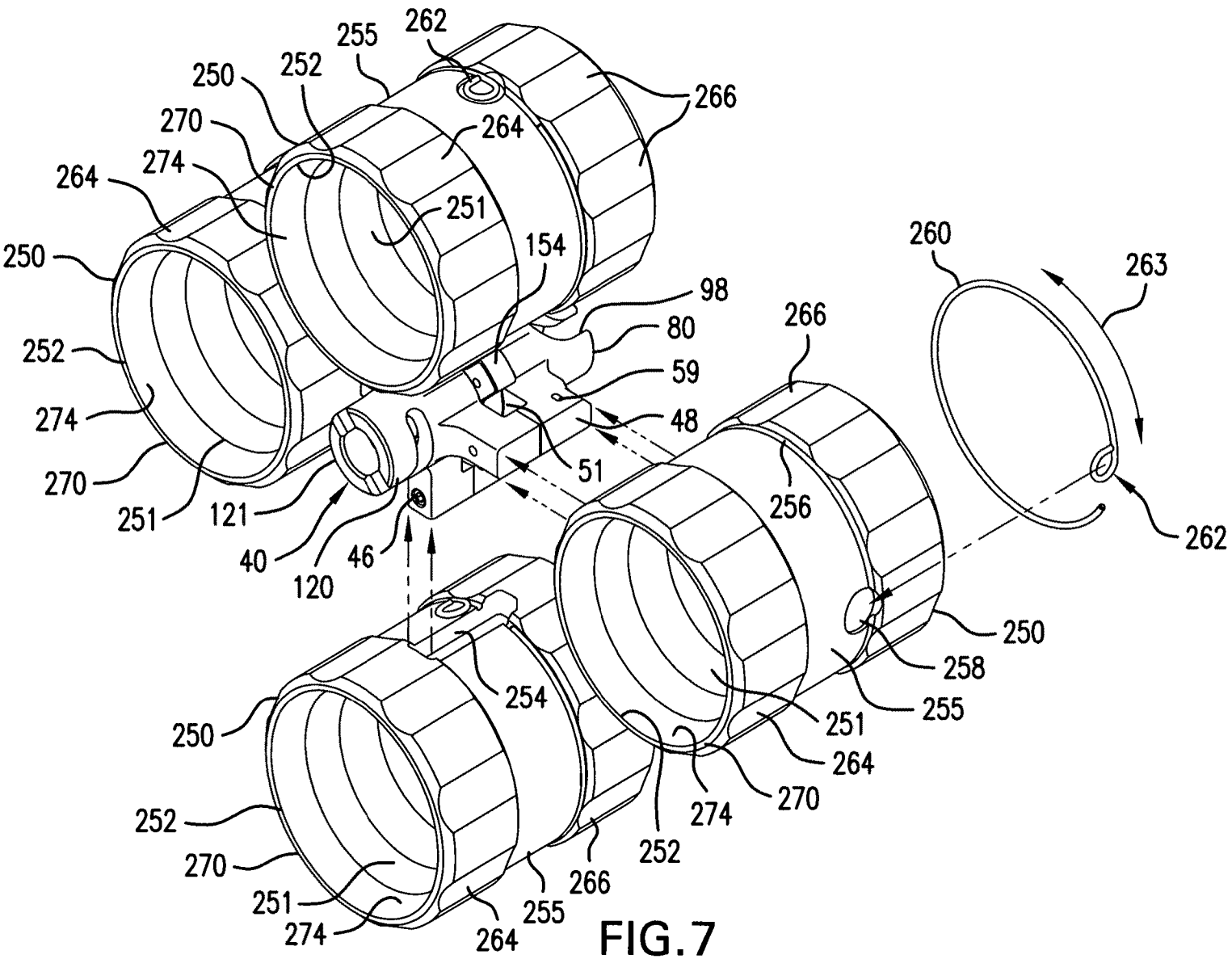
FIG. 7 is an exploded view illustrating the stop members attached to the locking bridge.

As previously described, a plurality of stop members 250 are attached to locking bridge 40 such that locking bridge 40 and stop members 250 function as a single component. The orientation of locking bridge 40 and stop members 250 may be easily reversed. For example, as shown in FIGS. 6 and 7, locking bridge 40 is oriented in central space 13 such that opening 84 of cylindrical body portion 80 faces the aft direction and opening 124 of generally cylindrical body portion 120 faces the forward direction. When a user is facing opening 84 and ends 22 of tubes 12 and the pivoting mechanism 100 is in the default state, the extending fingers 154 are positioned in notches 28. If the user is facing opening end 124 and ends 22 of tubes 12 and the pivoting mechanism 100 is in the default state, extending fingers 154 are positioned in notches 28. In order to reverse the orientation of locking bridge 40 so that opening 84 faces the forward direction and opening 124 faces the aft direction, a user inserts head section 105 of adjustment rod 102 into opening 80 as described in the foregoing description to pivot pivotable mechanism 100 in the counter-clockwise direction. The user continues to rotate adjustment rod 102 until protruding members 106 reach the end of curved slots 96 and 98 and extending fingers 154 enter or retracted into corresponding openings 51. Extending fingers 154 are now completely withdrawn from all notches 28. Since protruding members 106 are positioned at the ends of curved slots 96 and 98, the user can now use adjustment rod 102 to pull locking bridge 40 toward the ends 22 of tubes 12 until protruding sections 44, 46, 48 and 50 of housing 42 slide out of longitudinally extending slots 26. Once this occurs, locking bridge 40 and stop members 250 are completely disengaged from tubes 12. The user can now reverse the orientation of locking bridge 40, with stop members 250 attached, so that opening 124 faces the user. The user then aligns protruding sections 44, 46, 48 and 50 with corresponding longitudinally extending slots 26 and then maneuvers locking bridge 40 and stop members 250 so that protruding sections 44, 46, 48 and 50 enter the corresponding slots 26 and stop members 250 enter tubes 12. The user inserts head section 105 of adjustment rod 102 into opening 124 so that protruding members 106 enter curved slots 96 and 98 of generally cylindrical body portion 120 and key structure 108 enters second keyway 204. The user then rotates adjustment rod 102 clockwise in order to unlock locking bridge 40. The user then slides locking bridge 40 through central space 13 until the locking bridge 40 is aligned with a desired location along the lengths of tubes 12. The user then releases adjustment rod 102 so torsion springs 160 and 200 force pivotable member 100 in the counter-clockwise direction and extending fingers 154 enter notches 28 that are located at the desired location along the along the lengths of tubes 12. Locking bridge 40 is now in the locked state with its orientation and the orientation of stop members 250 being reversed. Thereafter, if it is desired to move locking bridge 40 to a different location along the lengths of tubes 12, then the user inserts head section 105 of adjustment rod 102 through opening 124 so that protruding members 106 enter curved slots 142 and 144 and key structure 108 enters second keyway 204 of second section 153. The user then uses adjustment rod 102 to pivot pivotable mechanism 100 clockwise so that extending fingers 154 are withdrawn from notches 28 and enter or retract into corresponding openings 51. Once extending fingers 154 are withdrawn from notches 28, the user may slide locking bridge 40 along the lengths of tubes 12A, 12B, 12C and 12D in order to position extending fingers 154 in a different set of notches 28 that correspond to a different point along the lengths of tubes 12A, 12B, 12C and 12D as described in the foregoing description. Once locking bridge 40 is aligned with the desired set of notches 28, the user releases adjustment rod 102 so that torsion springs 160 and 200 force pivotable mechanism 100 back to the default position wherein extending fingers 154 are inserted into the new set of notches 28. Locking bridge 40 is now in the locked state.

Referring to FIGS. 1A and 6-9, dunnage assembly 10 further comprises a plurality of stop members 250. Each stop member 250 has a generally cylindrical shape. Each stop member 250 is movably disposed within tube interior region 16 of a corresponding tube 12 and attached to locking bridge 40. Specifically, a first stop member 250 is attached to portion 52 of radially extending section 44. A second stop member 250 is attached to the portion 54 of radially extending section 46. A third stop member 250 is attached to the portion 56 of radially extending section 48. A fourth stop member 250 is attached to the portion 58 of radially extending section 50. Each stop member 250 has interior region 251, opening 252 and opposite opening 253. Openings 252 and 253 are in communication with interior region 251. Each stop member 250 has recessed area 254. Recessed area 254 extends in a direction that is substantially parallel to the longitudinally extending axis of stop member 250. Each stop member 250 has an exterior surface 255 and circumferentially extending groove 256. Groove 256 includes a generally circular portion 258, the purpose of which is described in the ensuing description. As described in the foregoing description, each portion 52, 54, 56 and 58 has a through-hole 59. Each stop member 250 is attached to a corresponding portion 52, 54, 56 and 58 by a corresponding retaining ring 260. Each retaining ring 260 is mounted to exterior surface 255 of stop member 250 and extends through a corresponding through-hole 59. Retaining rings 260 provide a "floating attachment" of stop members 250. Such a configuration allows stop members 250 to self-center in tubes 12 when the stop members 250 are being inserted into tubes 12. As shown in FIG. 9, each portion 52, 54, 56 and 58 extends into a corresponding recessed area 254. Recessed area 254 provides ample clearance away from the exterior surface 255 of stop member 250 to allow the retaining ring 260 to enter the corresponding through-hole 59. As shown in FIG. 7, retaining ring 260 is movably positioned in groove 256. Retaining ring 260 has a curled end portion 262 that is positioned within generally circular portion 258 of groove 256. Retaining ring 260 is configured to have a diameter that creates tension when retaining ring 260 is positioned on the circumference of a stop member 250. Such tension maintains retaining ring 260 in groove 256. In order to remove retaining ring 260 from stop member 250, a user may simply pry curled end portion 262 from generally circular portion 258 of groove 256 and then rotate retaining ring 260 in the appropriate direction, indicated by reference number 263 in FIG. 7, so as to remove the retaining ring 260 from the corresponding thru-hole 59. Retaining rings 260 keep stop members 250 attached to locking bridge 40 when locking bridge 40 is slid out of slots 26 and disengaged from tubes 12. Retaining rings 260 allow stop members 250 some degree of movement within tube interior regions 16 so as to allow stop members 250 to self-center and align with the rockets. The aforementioned degree of movement includes movement that is perpendicular to the centerline of the locking bridge 40.

As shown in FIGS. 6, 8 and 9, exterior surface 255 of stop member 250 has a first plurality of equidistantly spaced recessed areas 264 and a second plurality of equidistantly spaced recessed areas 266. When stop members 250 are within tubes 12, any debris or other particles in tube interior region 16 pass over recessed areas 264 and 266. Thus, such debris or particles will not interfere with the movement of stop members 250 within tube interior regions 16.

Stop members 250 may be attached to portions 52, 54, 56 and 58 via other techniques and methods, such as adhesives, screws, rivets or other similar fastening devices.

As previously described herein, when locking bridge 40 is configured to the unlocked state and is moved along the lengths of tubes 12 with adjustment rod 102, the stop members 250 move along with locking bridge 40. Each stop member 250 is configured to receive an end of a longitudinally extending object that is to be stored in tube interior region 16. In an exemplary embodiment, each stop member 250 is configured to receive the warhead or forward end of a rocket. Referring to FIGS. 6, 7 and 9, each stop member 250 has first end 270 and opposite second end 272. Each stop member 250 includes first interior surface 274 and second interior surface 275. Second interior surface 275 is contiguous with first interior surface 274. In an exemplary embodiment, first interior surface 274 has a substantially conical geometry and comprises portions 276, 278 and 280. Each portion 276, 278 and 280 corresponds to a particular warhead ogive profile. As result of this configuration, this portion of stop member 250 may accommodate three different warhead ogive profiles. Second interior surface 275 has a substantially cylindrical geometry. It is to be understood that first interior surface 274 may be configured to accommodate more than or less than three different warhead ogive profiles. Opposite second end 272 is flat and configured for a specific warhead profile that requires a flat perimeter area to constrain the rocket from forward movement. In other embodiments, each stop member 250 is configured so that end 272 is a closed end. In other exemplary embodiments, each stop member 250 is configured with a protruding structure that is configured to mate with particular types of objects that are to be stored within tube interior regions 16.

Figure 1A:
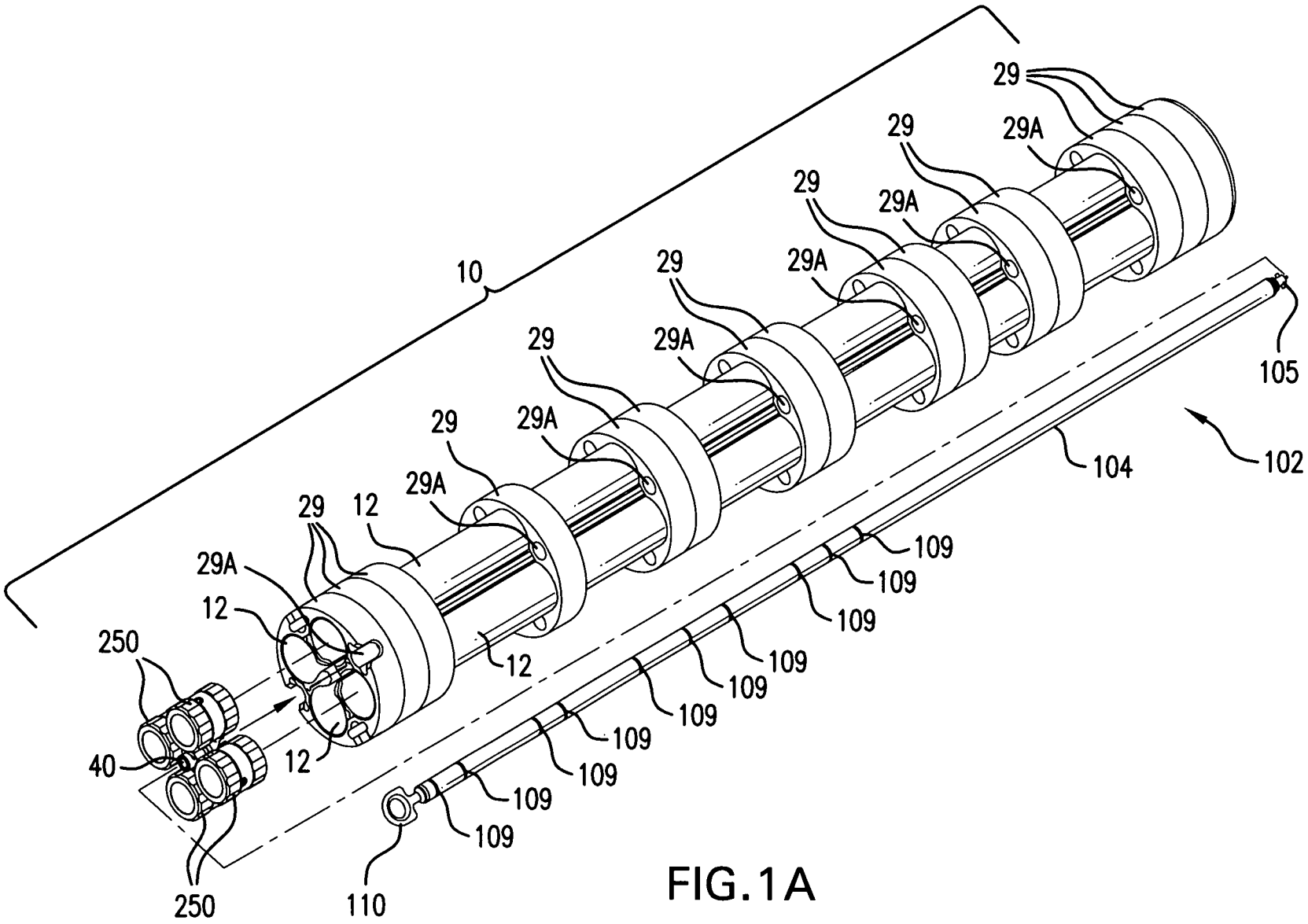
FIG. 1A is an exploded view of a dunnage assembly according to an exemplary embodiment.

Each notch 28 corresponds to particular location at which stop members 250 may be positioned. Notches 28 may be spaced apart by any suitable or desired distance. Thus, tubes 12 may accommodate longitudinally extending objects (e.g. rockets) of different lengths by repositioning stop members 250 within the tube interior regions 16. The shorter the length of the rocket, the closer stop members 250 will be to ends 22 of tubes 12. The longer the length of the rocket, the farther away stop members 250 will be from the ends 22 of tubes 12. In order for stop members 250 to be positioned at the desired location, locking bridge 40 must first be unlocked and moved through central space 13 until the locking bridge 40 is aligned with the notches 28 that correspond to the desired position for stop members 250. Referring to FIG. 1A, shaft 104 of adjustment rod 102 has a plurality of markings or indicia 109 thereon. Each marking 109 corresponds to particular location at which stop members 250 are to be located in order to accommodate a rocket of a particular length. For example, in an exemplary embodiment, if there are four different rocket lengths, then there are four markings 109 on shaft 104 that correspond to those four different rocket lengths and each tube 12 has four notches 28 in slot edge 27A and four notches 28 in slot edge 27B. As the user is moving locking bridge 40 through central space 13 with adjustment rod 102, the user will know when locking bridge 40 is aligned with the desired notches 28 when the corresponding marking 109 is aligned with the ends 22 of tubes 12. In addition to markings 109, there is also tactile feedback. Specifically, as locking bridge 40 is unlocked and moved up or down tubes 12 in order to position stop members 250 at a desired position, extending fingers 154 will automatically try to engage notches 28 in tubes 12 thereby providing tactile feedback every time the extending fingers 154 are at a notch location.

Since stop members 250 are attached to and move with locking bridge 40, the orientation of stop members 250 are also reversed when the orientation of locking bridge 40 is reversed. For example, if end portion 81 of locking bridge 40 is facing in the same direction as tube ends 22 and the first ends 270 of stop members 250 are also facing in the same direction as tube ends 22, and it is desired to reverse the orientation of stop members 250 in order to accommodate a different shaped warhead, locking bridge 40 is first unlocked and then withdrawn from central space 13 with adjustment rod 102 that that locking bridge 40 and stop members 250 are removed and disengaged from tubes 12. Next, locking bridge 40, with stop members 250 attached thereto, is reversed in orientation and then re-installed into central space 13 so that extending sections 44, 46, 48 and 50 are positioned in slots 26 and end 121 of locking bridge 40 and second ends 272 of stop members 250 all face in the same direction as tube ends 22.

Figure 1B:
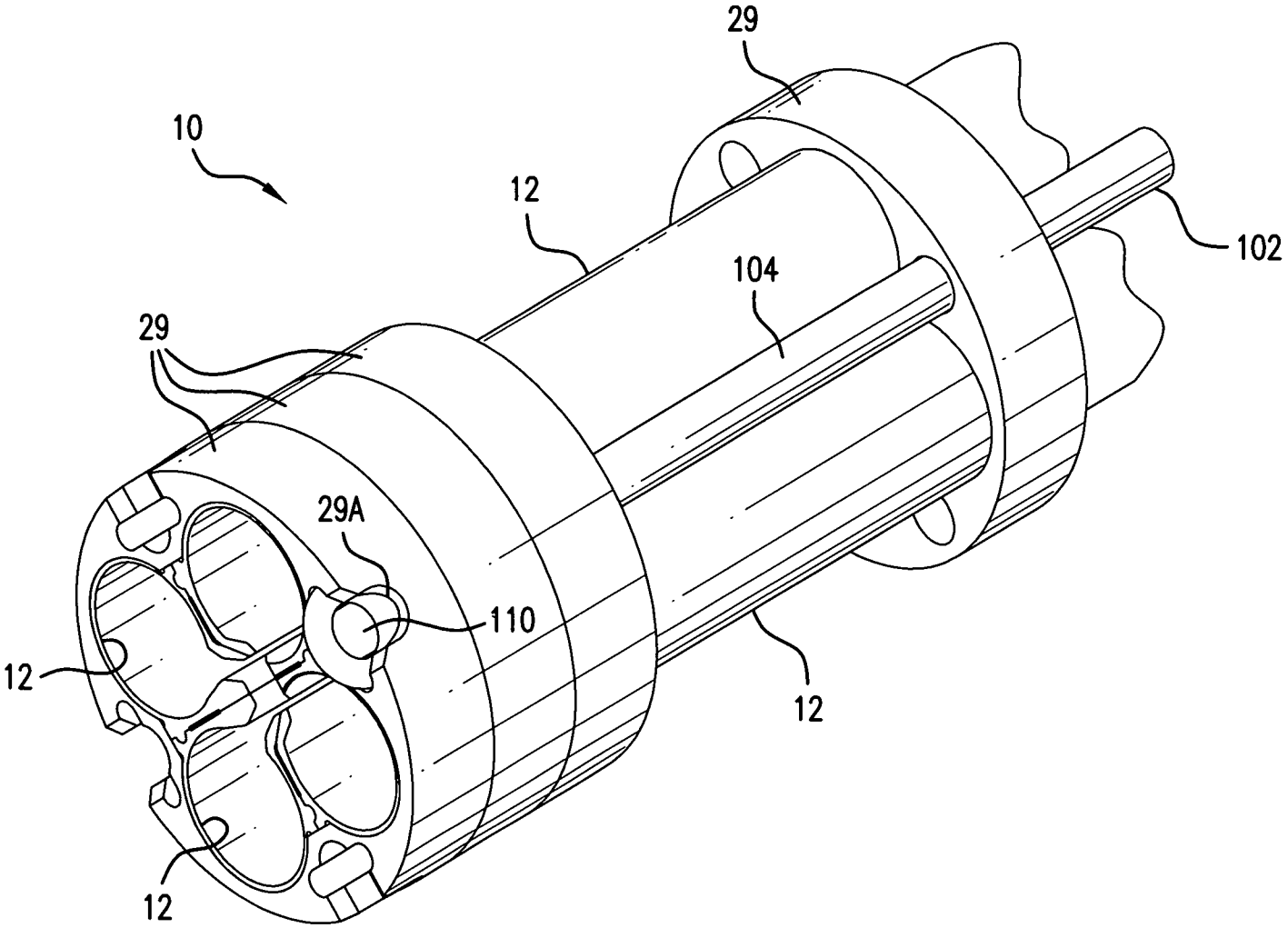
FIG. 1B is a partial view, in perspective, of the dunnage assembly, the view illustrating the storage of an adjustment rod.
Figure 2:
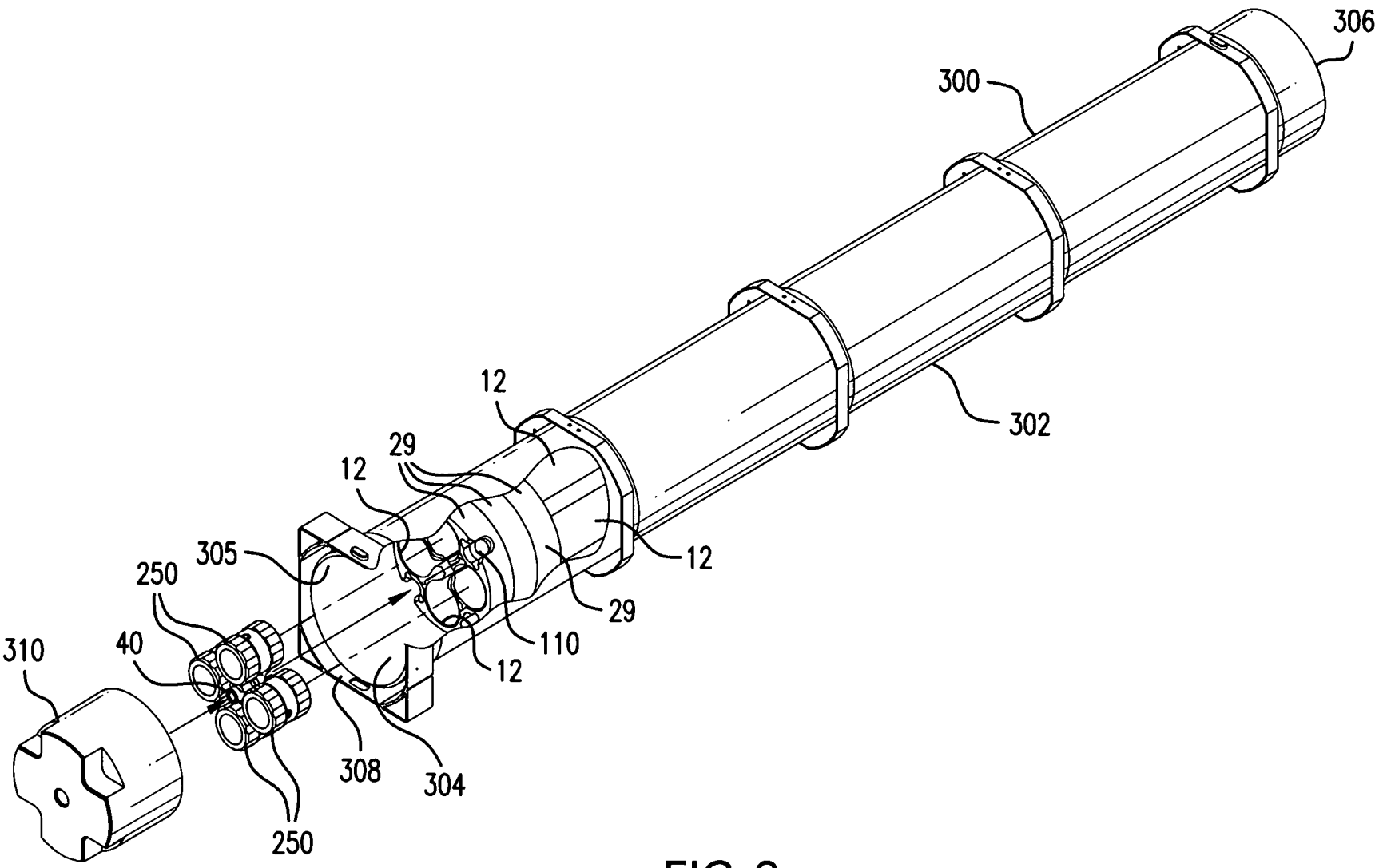
FIG. 2 is an exploded view showing storage tubes of the dunnage assembly disposed within a shipping container and the locking bridge and stop members of the dunnage assembly aligned for engagement with the storage tubes.
Figure 3:
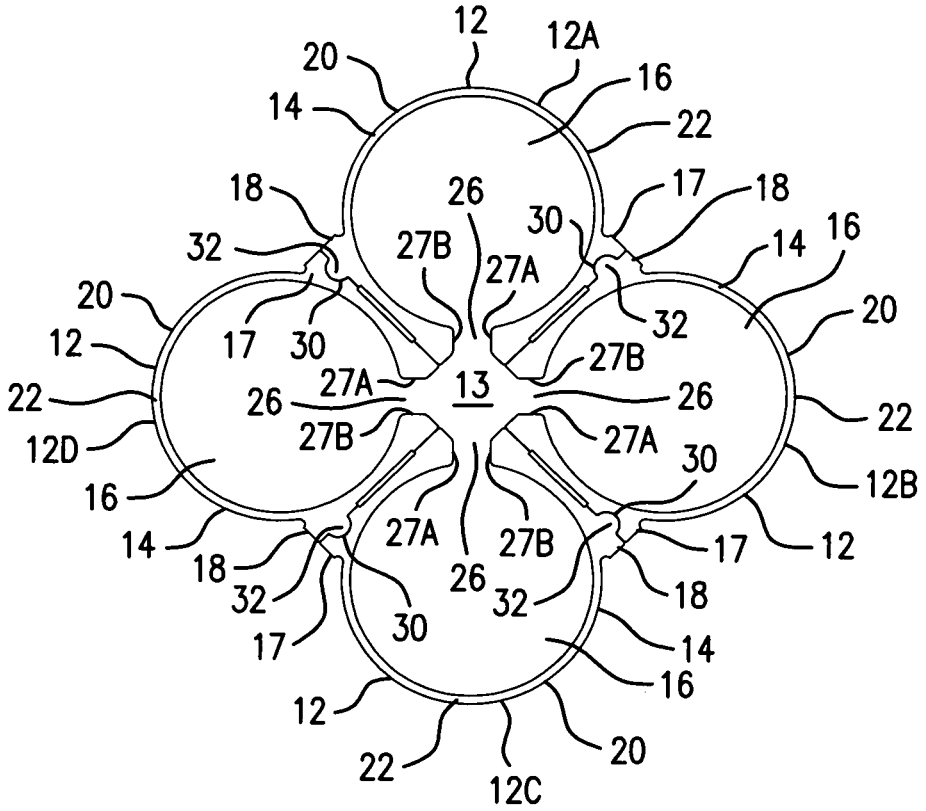
FIG. 3 is an end view of the storage tubes of the dunnage assembly, the collars not being shown in order to facilitate viewing of the structure of the storage tubes.
Figure 4:
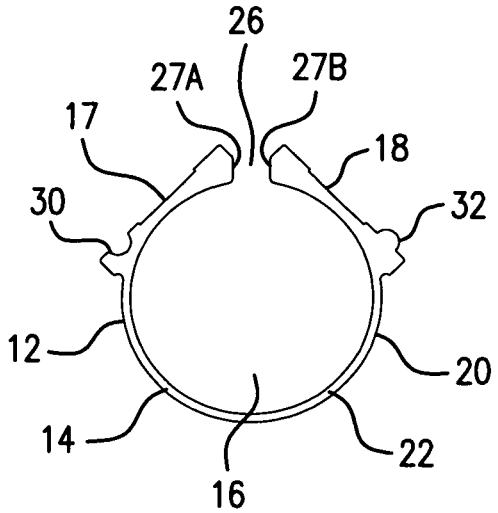
FIG. 4 is an end view of one of the storage tubes shown in FIG. 3.

Referring to FIG. 2, dunnage assembly 10 may be positioned into shipping container 300. Shipping container 300 may be any suitable commercially available shipping container. Shipping container 300 comprises container body 302 which has interior region 304 and interior surface 305 that extends about interior region 304. Interior region 304 is sized for receiving dunnage assembly 10. Container body 302 has closed forward end 306 and open aft end 308. Shipping container 300 includes aft cushion 310 that is configured to be positioned between ends 22 of tubes 12 and a container cover (not shown). Aft cushion 310 prevents axial movement of the rockets in tube interior regions 16 during shipment. Shipping container 300 may be fabricated from suitable materials such as wood or metal or any of the aforementioned materials from which tubes 12 may be fabricated. As shown in FIGS. 1 and 2, each tube collar 29 has a substantially circular shape, a circumferentially extending outer surface and a predetermined diameter that results in the circumferentially extending outer surface contacting interior surface 305 of container body 302. Thus, tube collars 29 prevent any movement of tubes 12 within interior region of container body 302. Tube collars 29 also provide cushioning in order to protect the contents of tubes 12. The adjustability of dunnage assembly 10 also allows for container 300 to be reconfigured, if necessary, to accommodate various sized rocket configurations.

Referring to FIGS. 1A and 1B, adjustment rod 102 may be stored within openings 29A in collars 29. Once adjustment rod 102 is secured in openings 29A, the adjustment rod 102 is in juxtaposition with tubes 12 and within the circumference of collars 29. Thus, adjustment rod 102 may be secured in collars 29 when dunnage assembly 10 is inserted into container 300.

Although the foregoing description is in terms of the dunnage assembly disclosed herein being used to hold and transport rockets, it is to be understood that the dunnage assembly may be used to hold and transport other types of longitudinally extending objects such as rods or tubular objects made of precious metals, composites or graphite, nuclear fuel rods for nuclear reactors or other fragile longitudinally extending objects.

The foregoing description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize. In this regard, while the disclosed subject matter has been described in connection with various embodiments and corresponding Figures, where applicable, it is to be understood that other similar embodiments can be used or modifications and additions can be made to the described embodiments for performing the same, similar, alternative or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A dunnage system, comprising:

a plurality of storage tubes being arranged in juxtaposition, wherein each tube is attached to at least one other tube, wherein said each tube includes a tube wall, a tube interior region, an open aft end in communication with the tube interior region and a forward end, wherein said each tube includes a longitudinally extending axis, a predefined length and a longitudinally extending tube slot that extends from the aft end to the forward end, wherein the tube slot has a first longitudinally extending edge and an opposing second longitudinally extending edge, wherein the first longitudinally extending edge includes a first plurality of notches therein and the opposing second longitudinally extending edge has a second plurality of notches therein, wherein each notch of the first plurality of notches is aligned with a corresponding notch of the second plurality of notches so as to define a pair of aligned notches, wherein each pair of aligned notches is located at a predefined location along the predefined length of the tube, and wherein the orientation and position of the tubes provides a longitudinally extending central space between the tubes which extends for the predefined length of the tubes;

a locking bridge being located within the longitudinally extending central space and comprising a plurality of radially extending sections, wherein each radially extending section of the plurality of radially extending sections extending through the tube slot of a corresponding tube and into the tube interior region such that the locking bridge is slidably engaged to each tube and movable through the longitudinally extending central space, wherein the locking bridge further comprises a pivotable mechanism including a plurality of radially extending fingers, wherein each radially extending finger is sized to fit into any of the notches in the first plurality of notches and the second plurality of notches, wherein the pivotable mechanism includes a torsion spring system to produce a torsion force to urge the pivotable mechanism to a first position, wherein each radially extending finger is inserted into a corresponding notch so as to lock the locking bridge, wherein the pivotable mechanism is pivotable to a second position, and wherein the fingers are withdrawn from the notches so as to unlock the locking bridge thereby allowing the locking bridge to move throughout the longitudinally extending central space; and a plurality of stop members, wherein each stop member of the plurality of stop members is positioned within a corresponding tube interior region and attached to a corresponding radially extending section such that the stop member moves through the tube interior region when the locking bridge moves throughout the longitudinally extending central space, wherein said each stop member is configured to receive an end of a longitudinally extending object that is to be stored in the tube interior region, wherein in order to position each stop member at a desired location within a corresponding tube interior region, the pivotable mechanism is pivoted to the second position to withdraw the radially extending fingers from the notches so as to unlock the locking bridge so that the locking bridge may be moved through the longitudinally extending central space until the stop members are positioned at the desired location, and wherein the torsion spring system is allowed to force pivotable mechanism to the first position so as to position the radially extending fingers in the notches corresponding to the desired location and lock the locking bridge.

2. The dunnage assembly according to claim 1, wherein said each tube is removably attached to said at least one other tube.

3. The dunnage assembly according to claim 1, wherein the tube wall of each tube includes an exterior side, a longitudinally extending groove in the exterior side and a longitudinally extending rib on the exterior side, and wherein each longitudinally extending rib is sized to frictionally fit into the longitudinally extending groove in the tube wall of an adjacent tube.

4. The dunnage assembly according to claim 1, wherein said each stop member is removably attached to the corresponding radially extending section.

5. The dunnage assembly according to claim 1, wherein said each radially extending section includes a through-hole therein.

6. The dunnage assembly according to claim 5, further comprising a plurality of retaining rings, wherein each retaining ring of said plurality of retaining rings is removably secured to a corresponding said stop member and extends through a corresponding said through-hole.

7. The dunnage assembly according to claim 1, wherein said each stop member is generally cylindrical in shape and includes an interior space, a first end having a first opening in communication with the interior space and an opposite second end, wherein said each stop member includes an interior surface that extends about the interior space, and wherein the interior surface includes a portion that corresponds to a warhead of a given profile.

8. The dunnage assembly according to claim 1, wherein the locking bridge comprises a first housing section and a second housing section, wherein the first housing section includes a first interior space and a first opening in communication with the first interior space, wherein the first opening is sized to allow insertion therethrough of an adjustment rod configured to engage the pivotable mechanism and pivot the pivotable mechanism to the second position so as to withdraw the fingers from the notches and unlock the locking bridge, wherein the second housing section is attached to the first housing section and has a second interior space and a second opening in communication with the second interior space, and wherein the second opening is coaxially aligned with the first opening and sized to allow insertion therethrough of the adjustment rod to engage and pivot the pivotable mechanism to the second position so as to withdraw the fingers from the notches and unlock the locking bridge.

9. The dunnage assembly according to claim 8, wherein the pivotable mechanism further comprises a central body, a first generally cylindrical section, a first torsion spring, a second generally cylindrical section, and a second torsion spring, wherein the central body to which the radially extending fingers are attached, wherein the first generally cylindrical section attached to the central body and extends into the first interior space of the first housing section, wherein the first generally cylindrical section includes a first keyway accessible through the first opening in the first housing section and configured to receive a key structure of the adjustment rod, wherein the first torsion spring mounted on the first generally cylindrical section and engaged with the first housing section, wherein the second generally cylindrical section attached to the central body and extends into the second interior space of the second housing section, wherein the second generally cylindrical section is coaxially aligned with the first generally cylindrical section and has a second keyway accessible through the second opening in the second housing section and configured to receive the key structure of the adjustment rod, wherein the second torsion spring mounted on the second generally cylindrical section and engaged with the second housing section, and wherein the first torsion spring and the second torsion spring cooperate to produce said torsion force.

10. The dunnage assembly according to claim 1, wherein the radially extending sections of the locking bridge are equidistantly spaced apart.

11. The dunnage assembly according to claim 10, wherein the radially extending fingers are equidistantly spaced apart.

12. The dunnage assembly according to claim 1, further comprising a plurality of collars extending about the plurality of tubes.

13. The dunnage assembly according to claim 1, wherein the plurality of tubes comprises four tubes.

14. A dunnage system, comprising:

a plurality of storage tubes being arranged in juxtaposition, each tube of said plurality of storage tubes includes a tube wall, a tube interior region, an open aft end in communication with the tube interior region and a forward end, wherein said each tube includes a longitudinally extending axis and a predefined length, wherein the tube wall of said each tube has an exterior side, a longitudinally extending groove in the exterior side and a longitudinally extending rib on the exterior side, wherein each said longitudinally extending rib is sized to frictionally fit into the longitudinally extending groove in the tube wall of an adjacent tube so as to allow each tube to be removably attached to at least one other tube, wherein each tube includes a longitudinally extending tube slot that extends from the aft end to the forward end, wherein the tube slot includes a first longitudinally extending edge and an opposing second longitudinally extending edge, wherein the first longitudinally extending edge has a first plurality of notches therein and the opposing second longitudinally extending edge has a second plurality of notches therein, wherein each notch of the first plurality of notches is aligned with a corresponding notch of the second plurality of notches so as to define a pair of aligned notches, wherein each pair of aligned notches is located at a predefined location along the predefined length of the tube, and wherein the orientation and position of the tubes provides a longitudinally extending central space between the tubes which extends for the predefined length of the tubes;

a locking bridge being located within the longitudinally extending central space and comprising a plurality of radially extending sections, wherein the radially extending sections are equidistantly spaced and each radially extending section extends through the tube slot of a corresponding tube and into the tube interior region such that the locking bridge is slidably engaged to each tube and movable through the longitudinally extending central space, wherein the locking bridge further comprises a pivotable mechanism having a plurality of radially extending fingers, wherein the plurality of radially extending fingers are equidistantly spaced and wherein each radially extending finger of the plurality of radially extending fingers is sized to fit into any of the notches of the first plurality of notches and the second plurality of notches, wherein the pivotable mechanism comprises a torsion spring system to produce a torsion force to urge the pivotable mechanism to a first position wherein each radially extending finger is inserted into a corresponding notch so as to lock the locking bridge, wherein the pivotable mechanism is pivotable to a second position, and wherein the fingers are withdrawn from the notches so as to unlock the locking bridge thereby allowing the locking bridge to move throughout the longitudinally extending central space;

a plurality of stop members, wherein each stop member of the plurality of stop members is positioned within a corresponding tube interior region and attached to a corresponding radially extending section such that the stop member moves through the tube interior region when the locking bridge moves throughout the longitudinally extending central space, wherein said each stop member is configured to receive an end of a longitudinally extending object that is to be stored in the tube interior region, wherein in order to position each stop member at a desired location within a corresponding tube interior region, the pivoting mechanism is pivoted to the second position to withdraw the radially extending fingers from the notches so as to unlock the locking bridge so that the locking bridge may be moved through the longitudinally extending central space until the stop members are positioned at the desired location, and wherein the torsion spring system is allowed to force the pivoting mechanism to the first position so as to position the radially extending fingers in the notches corresponding to the desired location and lock the locking bridge.

15. The dunnage assembly according to claim 14, wherein the locking bridge comprises a first housing section and a second housing section, Wherein the first housing section includes a first interior space and a first opening in communication with the first interior space, wherein the first opening is sized to allow insertion therethrough of an adjustment rod configured to engage the pivotable mechanism and pivot the pivotable mechanism to the second position so as to withdraw the fingers from the notches and unlock the locking bridge, wherein the second housing section is attached to the first housing section and has a second interior space and a second opening in communication with the second interior space, and wherein the second opening is coaxially aligned with the first opening and sized to allow insertion therethrough of the adjustment rod to engage and pivot the pivotable mechanism to the second position so as to withdraw the fingers from the notches and unlock the locking bridge.

16. The dunnage assembly according to claim 15, wherein the pivotable mechanism further comprises a central body, a first generally cylindrical section, a first torsion spring, a second generally cylindrical section, and a second torsion spring, wherein the central body to which the radially extending fingers are attached, wherein the first generally cylindrical section attached to the central body and extends into the first interior space of the first housing section, wherein the first generally cylindrical section includes a first keyway accessible through the first opening in the first housing section and configured to receive a key structure of the adjustment rod, wherein the first torsion spring mounted on the first generally cylindrical section and engaged with the first housing section, wherein the second generally cylindrical section attached to the central body and extending into the second interior space of the second housing section, the second generally cylindrical section being coaxially aligned with the first generally cylindrical section and having a second keyway accessible through the second opening in the second housing section and configured to receive the key structure of the adjustment rod, wherein the second torsion spring mounted on the second generally cylindrical section and engaged with the second housing section, and wherein the first torsion spring and the second torsion spring cooperate to produce said torsion force.

17. The dunnage assembly according to claim 14, wherein said each stop member is removably attached to the corresponding radially extending section.

18. The dunnage assembly according to claim 14, wherein said each radially extending section has a through-hole therein.

19. The dunnage assembly according to claim 18, further comprising a plurality of retaining rings, wherein each retaining ring of said plurality of retaining rings is removably secured to a corresponding stop member and extends through a corresponding through-hole.

20. The dunnage assembly according to claim 14, wherein said each stop member is generally cylindrical in shape and includes an interior space, a first end having a first opening in communication with the interior space and an opposite second end, wherein said each stop member includes an interior surface that extends about the interior space, and wherein the interior surface includes a portion that corresponds to a warhead of a given profile.

* * * * *